US005421086A

United States Patent [19]

Le Gauyer

[11] Patent Number: 5,421,086

[45] Date of Patent: Jun. 6, 1995

[54] METHOD OF PUNCHING A THROUGH OPENING IN A TUBULAR WALL

[75] Inventor: Philippe Le Gauyer, Paris, France

[73] Assignee: Valeo Thermique Moteur, Le Mesnil-Saint-Denis, France

[21] Appl. No.: 297,421

[22] Filed: Aug. 5, 1994

Related U.S. Application Data

[63] Continuation of Ser. No. 947,042, Sep. 18, 1992, abandoned.

[30] Foreign Application Priority Data

Sep. 19, 1991 [FR] France ..... 91 11571

[51] Int. Cl.[6] ..... B23P 15/00

[52] U.S. Cl. ..... 29/890.053; 29/890.052

[58] Field of Search ..... 29/890.052, 890.053, 29/890.043, 890.08, 557; 165/173

[56] References Cited

U.S. PATENT DOCUMENTS

| | | | |
|---|---|---|---|
| 2,829,983 | 4/1956 | DeGain | 164/108 |
| 2,972,779 | 2/1961 | Cowley | 18/48 |
| 3,108,362 | 10/1963 | Huet | 29/890.053 |
| 3,158,119 | 11/1964 | Thaller et al. | 29/890.053 |
| 5,088,193 | 2/1992 | Okada et al. | 29/890.052 |
| 5,090,477 | 2/1992 | Sprow et al. | 29/890.052 |
| 5,172,762 | 12/1992 | Shinmura et al. | 29/890.052 |

OTHER PUBLICATIONS

Werkstattstechnik, Zeitschrift fur Industrielle Fertigung, vol. 69, No. 12, Dec. 1979, pp. 777-780.

*Primary Examiner*—Irene Cuda

*Attorney, Agent, or Firm*—Morgan & Finnegan

[57] ABSTRACT

A heat exchanger has a manifold with a tubular wall. A through aperture is formed in the tubular wall by means of a punch having a cylindrical outer surface terminating in a cutting edge. The punch is moved in a forward stroke in the direction of the generatrices of its cylindrical surface so that the cutting edge comes into contact with the outside of the wall and then passes through its thickness so as to form the aperture.

In order to eliminate a sharp edge causing possible damage to a tube subsequently inserted in the aperture, and to ensure correct centring of such a tube, the cylindrical surface of the punch is joined, at its end opposite to the cutting edge and over at least part of its perimeter, to a surface portion of the punch which is inclined outwardly from the cylindrical surface. At the end of the forward stroke of the punch, the inclined surface portion deforms the tubular wall so as to form a flared portion of the aperture.

3 Claims, 1 Drawing Sheet

METHOD OF PUNCHING A THROUGH OPENING IN A TUBULAR WALL

This is a continuation of application Ser. No. 07/947,042, filed on Sep. 18, 1992, abandoned.

FIELD OF THE INVENTION

This invention relates to the manufacture of tubular walls for fluid manifolds of heat exchangers, especially those which are used in the condensers of air conditioning apparatus for motor vehicles. More particularly, the invention is concerned with the formation, in a tubular wall of such a heat exchanger manifold, of through apertures for receiving the ends of fluid circulation tubes of the heat exchanger.

BACKGROUND OF THE INVENTION

One known method for forming such a through aperture uses a punch which has an outer cylindrical surface terminating in a cutting edge, the punch being displaced in the direction of the generatrices of its cylindrical surface with respect to the tubular wall, so that the cutting edge comes into contact With the latter on the outside and passes through its thickness so as to form the aperture, the peripheral surface of the latter being entirely in contact with the cylindrical surface of the punch at the end of the forward stroke of the punch.

Such a method produces a through aperture having a cylindrical peripheral surface joined to the outer surface of the tubular wall, in the portions which are furthest away from the axial plane of the tubular wall parallel to the generatrices of the cylindrical surface of the punch, with an acute angle being defined between the cylindrical peripheral wall of the aperture and the cylindrical outer surface of the tubular wall. This acute junction angle defines a cutting edge, which tends to make a nick in the end of the tube when the latter is being inserted into the aperture if it is not perfectly aligned with the aperture. This danger is increased according to the number of tubes to be fitted simultaneously, being greater the greater the number of tubes.

DISCUSSION OF THE INVENTION

The object of the invention is to overcome this drawback.

In accordance with the invention in a first aspect, there is provided a method of forming a through aperture in a tubular wall of a heat exchanger manifold, by means of a punch having a cylindrical outer surface terminating at one of its ends in a cutting edge, the punch being displaced in the direction of the generatrices of its cylindrical surface with respect to the tubular wall, in such a way that the cutting edge comes into contact with the latter from the outside and passes through its thickness so as to form the aperture, characterised in that the said cylindrical surface is joined, at its end remote from the cutting edge and over at least part of its perimeter, to a surface portion of the punch which is inclined outwardly from the cylindrical surface, and in that at the end of the forward stroke of the punch, the inclined surface portion deforms the tubular wall so as to expand the aperture.

Preferably, in the position of the punch at the end of its forward stroke, the inclined surface portion is in contact with a flared portion of the peripheral surface of the aperture adjacent to the outer surface of the tubular wall, while the cylindrical surface of the punch, in the said portion of its perimeter, is in contact with a cylindrical portion of the peripheral surface of the aperture adjacent to the inner face of the tubular wall. Thus, the tube is first centred by the flared outer portion of the surface of the aperture, and is then guided with minimal clearance by the inner cylindrical portion of this surface.

In the preferred case in which the aperture, and the transverse cross section of the cylindrical surface of the punch, are elongated in the circumferential direction of the tubular wall, two inclined surface portions are preferably provided, these being adjacent respectively to the two transverse ends of the cross section of the cylindrical surface. It is at the level of these two transverse ends that the junction angle between the cylindrical surface of the aperture (in the absence of any flaring) and the outer face of the tubular wall would be sharpest. In addition, centring of the tube at the two ends of the elongated transverse cross section is sufficient to ensure that it is fully and properly located.

According to the invention in a second aspect, a tubular wall for a heat exchanger manifold, of a kind that may be made by the method according to the invention in its said first aspect, has a plurality of through apertures which are elongated in the circumferential direction of the tubular wall, the peripheral surface of the tubular wall having, in the end regions of the said through apertures, a portion which is flared outwardly and which extends from the outer surface of the tubular wall over at least part of the thickness of the latter.

In the case in which the flared portion of the aperture extends only over a part of the thickness of the wall, it may be joined (in the region corresponding to the said transverse ends of the cylindrical surface of the punch) to a cylindrical surface portion of the aperture extending over the remaining part of the wall thickness, this remaining part being consequently adjacent to the inner face of the tubular wall.

Further features and advantages of the invention will appear more clearly from the description of a preferred embodiment of the invention which follows, and which is given by way of example only and with reference to the accompanying drawings.

DESCRIPTION OF A PREFERRED EMBODIMENT OF THE INVENTION

Figure 1:
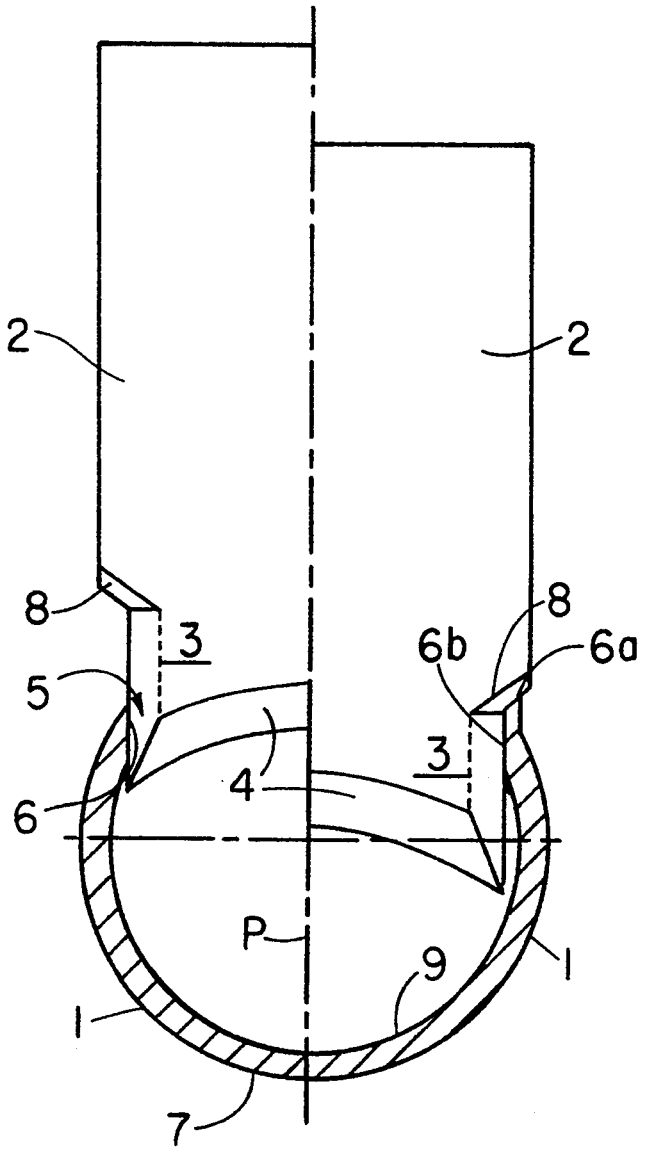
FIG. 1 is a view in axial cross section of a tubular wall of a fluid manifold for a heat exchanger showing two successive phases in the method of the invention.

FIG. 1 shows the formation of a through aperture in the tubular wall 1 of a manifold of a heat exchanger. The aperture is made by means of a punch 2 having a cylindrical outer surface 3 which is joined at one end to a recessed portion 4 which is formed with a cutting edge. The punch is driven towards and through the wall 1, in the direction of the arrow F, parallel to the generatrices of the cylindrical surface 3. In the left hand half of FIG. 1, the edge 4 is shown as having essentially passed through the thickness of the wall 1, having thereby formed a through aperture 5. In the region of the peripheral surface 6 of the aperture 5 adjacent to the outer surface 7 of the wall 1, the surface 6 is cylindrical and in contact with the cylindrical outer surface 3 of the punch. The cylindrical surface 6 is joined to the surface 7 in the regions furthest away from the axial plane P of the wall 1 that lies parallel to the arrow F. The surfaces 6 and 7 make a small acute angle with each other.

If the forward movement of the punch were stopped at this stage as is the case in the method already known, the edge which is defined by this acute angle would have a tendency to damage the fluid flow tube which is later provided for penetration through the aperture, and might even prevent that tube being introduced at all.

In the present case, and as shown in the drawings, the cylindrical surface 3 of the punch 2 is joined, away from the cutting edge 4, to a surface portion 8 which is inclined outwardly away from the cylindrical surface 3. At the end of the course of travel of the punch, as is shown in the right hand half of FIG. 1, the inclined surface portion 8 deforms the tubular wall 1 in such a way as to enlarge the aperture, which is elongated in the circumferential direction of the tubular wall in the vicinity of its two ends. The inclined surface portion 8 is then in contact with the expanded or flared portions 6*a* of the peripheral surface of the aperture 5, adjacent to the outer surface 7 of the tubular wall. At the same time, the cylindrical surface 3 of the punch is in contact with cylindrical portions 6*b* of the peripheral surface of the aperture, again in the vicinity of the ends of the latter and adjacent to the inner surface 9 of the wall 1.

Figure 2:
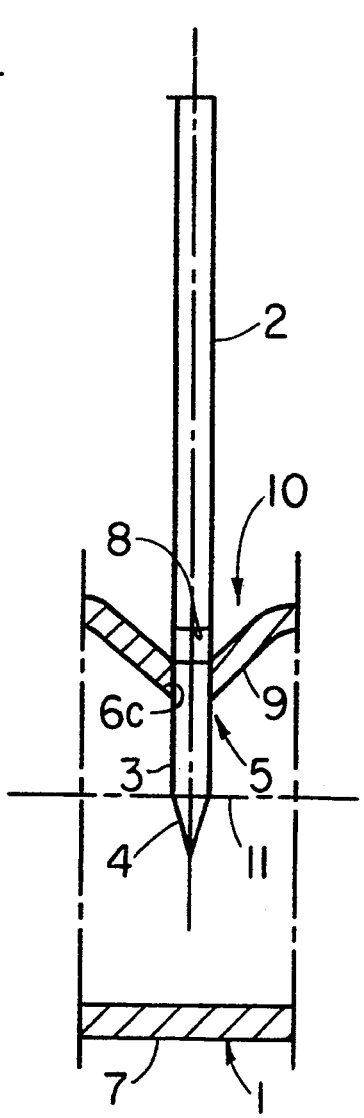
FIG. 2 is a side view of part of the said tubular wall in the second of these phases, the tubular wall being itself shown in axial cross section.

By contrast, and as shown in FIG. 2, in the region of the plane P where the penetration off the cutting edge 4 of the punch forms a depression 10 in the wall 1, with the outer surface 7 being inclined in the depression 10 with respect to the longitudinal axis 11 of the tubular wall 1, only the cylindrical surface 3 comes into contact with the peripheral surface of the aperture 5. In this way two surface portions 6*c* of the aperture 5 are defined. These surface portions 6*c* extend in planes which are at right angles to the axis of the tubular wall 1 over the whole thickness of the latter. These surface portions 6*c* are joined to the outer surface 7 in an obtuse angle, such that centring of the tube in the direction of the axis 11 is assured. No purpose is then served in the inclined surface portion 8 of the punch extending over the whole perimeter of the latter. This surface portion is therefore limited to separate portions lying in the regions furthest away from the plane P.

Figure 3:
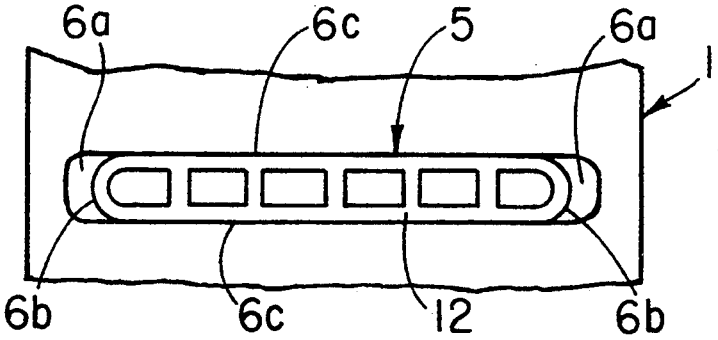
FIG. 3 is a view in elevation showing part of the same tubular wall, with a fluid flow tube introduced into the finished aperture.

The extent of the flared surface portions 6*a* is limited in the direction of the thickness of the wall 1 as shown in FIG. 1, and also in the circumferential direction of the aperture 5 as is seen in FIGS. 2 and 3. These flared surface portions 6*a* ensure centring of the end of the tube 12 in the direction at right angles to the plane P, and also ensure that the tube 12 can easily be introduced into the aperture, with the cylindrical portions 6*b* and 6*c* maintaining the tube 12 accurately in its final position.

What is claimed is:

1. A method of forming a through aperture having a flared portion in a tubular wall of a heat exchanger manifold, consisting essentially of the steps of:

providing a punch formed with a cylindrical outer surface having a leading end and a trailing end, a cutting edge joined to the said cylindrical outer surface at the said leading end of the latter, and a surface portion joined to the cylindrical surface over at least part of the periphery of the latter at the said trailing end of the cylindrical surface, the said surface portion being inclined outwardly from the cylindrical surface;

advancing the punch in a forward stroke in the direction of the generatrices of its cylindrical surface, towards the tubular wall so that its cutting edge comes into contact with the outside of the latter;

continuing the forward stroke of the punch so that the cutting edge passes through the thickness of the tubular wall so as to form a said aperture; and continuing the forward stroke of said punch to a position at the end of the stroke in which the said inclined punch surface portion deforms the tubular wall into a flared shape whereby to form said flared portion.

2. A method according to claim 1, in which the tubular wall has an outer surface and an inner surface, for forming a said through aperture which has a peripheral surface comprising a cylindrical portion adjacent to the said inner surface of the tubular wall, wherein the punch, at the end of its forward stroke, forms in the peripheral surface of the aperture a flared portion adjacent to the said outer surface of the tubular wall, the said inclined surface portion of the punch then being in contact with the said flared portion, with the said cylindrical surface of the punch being in contact with the said cylindrical portion of the peripheral surface of the aperture in the said part of the periphery of the cylindrical surface of the punch over which the latter is joined to its inclined surface portion.

3. A method according to claim 1, wherein the transverse cross section of the cylindrical surface of the punch, and consequently the aperture formed thereby, is elongated in the circumferential direction of the tubular wall, the punch having two said inclined surface portions which are adjacent respectively to the two ends of the transverse cross section of its cylindrical surface.

* * * * *